US006938305B2

(12) United States Patent
Garver

(10) Patent No.: US 6,938,305 B2
(45) Date of Patent: Sep. 6, 2005

(54) ELECTRICAL ASSEMBLY INCLUDING AN ELECTRICAL TIE

(75) Inventor: Scott A. Garver, Fort Wayne, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/056,170

(22) Filed: Jan. 24, 2002

(65) Prior Publication Data

US 2003/0135958 A1 Jul. 24, 2003

(51) Int. Cl.[7] ..... B65D 63/10
(52) U.S. Cl. ..... 24/16 PB
(58) Field of Search ..... 24/16 PB, 16 R, 24/17 A, 17 AP, 30.5 P, 30.5 R; 248/74.1–74.3; 292/318

(56) References Cited

U.S. PATENT DOCUMENTS

| | | | | | |
|---|---|---|---|---|---|
| 3,147,523 | A | * | 9/1964 | Logan | 24/16 PB |
| 3,461,510 | A | * | 8/1969 | Holmes | 24/16 PB |
| 3,717,906 | A | * | 2/1973 | Wells | 24/16 PB |
| 4,573,242 | A | * | 3/1986 | Lankton et al. | 24/16 PB |
| 4,788,751 | A | * | 12/1988 | Shely et al. | 24/16 PB |
| 5,031,943 | A | * | 7/1991 | Scott et al. | 292/207 R |
| 5,183,301 | A | * | 2/1993 | Lundberg, Jr. | 292/318 |
| 5,193,254 | A | * | 3/1993 | Geisinger | 24/16 PB X |
| 5,295,285 | A | * | 3/1994 | Shely | 24/16 PB |
| 5,304,188 | A | * | 4/1994 | Marogil | 606/157 |
| 5,317,787 | A | * | 6/1994 | Fortsch | 24/16 PB |
| 5,398,383 | A | * | 3/1995 | Bingold | 24/16 PB |
| 5,524,945 | A | * | 6/1996 | Georgopoulos et al. | 292/307 A |
| 5,577,698 | A | * | 11/1996 | Liu et al. | 24/16 PB |
| 5,598,994 | A | * | 2/1997 | Olewinski et al. | 248/73 |
| 5,758,390 | A | * | 6/1998 | Villeneuve | 24/16 PB |
| 5,848,771 | A | * | 12/1998 | Hancock-Bogese et al. | 248/74.3 |
| 5,884,367 | A | * | 3/1999 | Teagno et al. | 24/16 PB |
| 5,911,368 | A | * | 6/1999 | Davignon | 24/16 PB |
| 6,185,792 | B1 | * | 2/2001 | Nelson et al. | 24/16 PB |
| 6,364,257 | B1 | * | 4/2002 | Holder | 248/74.3 |
| 6,594,867 | B1 | * | 7/2003 | Pettersson | 24/16 PB |

FOREIGN PATENT DOCUMENTS

| | | | | |
|---|---|---|---|---|
| EP | 0 398 562 A1 | * | 11/1990 | |
| EP | 0 540 475 A2 | * | 5/1993 | 24/16 R |
| EP | 0 583 554 A1 | * | 2/1994 | 24/16 R |
| EP | 0 875 466 A1 | * | 11/1998 | 24/16 R |
| GB | 2 166 188 A | * | 4/1986 | 24/16 R |
| WO | WO 96/18554 | * | 6/1996 | 24/16 R |

* cited by examiner

*Primary Examiner*—Robert J. Sandy
*Assistant Examiner*—Ruth C. Rodriguez
(74) *Attorney, Agent, or Firm*—Taylor & Aust, P.C.

(57) ABSTRACT

An electrical assembly includes an electrical convoluted tubing, at least one electrical conductor and an electrical tie. The electrical convoluted tubing includes an outer surface having a plurality of generally parallel, annular convolutions defining respective grooves therebetween. Each groove has a width. The at least one electrical conductor is positioned within the tubing. The electrical tie is positioned around the tubing and includes a head and an elongate strap. The elongate strap has opposing sides and an end. The end is attached to the head. At least one of the sides has at least one longitudinally extending rib, with each rib having a width which is less than the groove width.

8 Claims, 4 Drawing Sheets

ELECTRICAL ASSEMBLY INCLUDING AN ELECTRICAL TIE

BACKGROUND OF THE INVENTION

1. Field of the Invention

The present invention relates to electrical ties, and, more particularly, to electrical ties used to hold wires, cables, tubing and other elongate electrical elements together.

2. Description of the Related Art

Convoluted tubing in an electrical assembly is used to carry electrical conductors from one location to another and protect the electrical conductors from damage caused by electrical contact such as may occur during impact or vibration. Electrical convoluted tubing typically includes a plurality of generally parallel, annular convolutions which allow the tubing to be flexed as it extends from one location to another. The tubing may include a longitudinal split along one side thereof allowing the electrical conductors to be inserted or removed therefrom.

To prevent the convoluted tubing from being physically damaged and thereby possibly damage the electrical conductors therein, it is also known to carry the convoluted tubing within a rubber grommet positioned within a cut-out in a mounting bracket. For example, electric motors, engines, household appliances, etc. may include mounting brackets for carrying rubber grommets. The grommet is a separate piece which is first inserted into the cut-out in the mounting bracket. Thereafter, the convoluted tubing, with the electrical conductors therein, is pulled through the opening in the rubber grommet.

It is also known to utilize electrical ties (sometimes called cable ties) to hold the convoluted tubing at various selected locations. Such an electrical tie typically includes a single row of serrations on one side of the elongate strap which engages with a single tooth inside a locking slot formed in the head of the electrical tie. Such an electrical tie is quite limited in the scope of applications, since the elongate strap must be received in the locking slot of the head in a single orientation, and the tie cannot be rigidly mounted to a separate mounting structure.

What is needed in the art is an electrical tie which inhibits longitudinal movement of the convoluted tubing, allows insertion of the elongate strap in either selected orientation, allows the electrical tie to be rigidly affixed to a mounting surface, and allows the electrical tie to flex relative to the mounting surface.

SUMMARY OF THE INVENTION

The present invention provides an electrical assembly including an elongate strap which inhibits longitudinal movement of a convoluted tubing and securely yet flexibly mounts the convoluted tubing relative to a mounting surface.

The invention comprises, in one form thereof, an electrical assembly including an electrical convoluted tubing, at least one electrical conductor and an electrical tie. The electrical convoluted tubing includes an outer surface having a plurality of generally parallel, annular convolutions defining respective grooves therebetween. Each groove has a width. The at least one electrical conductor is positioned within the tubing. The electrical tie is positioned around the tubing and includes a head and an elongate strap. The elongate strap has opposing sides and an end. The end is attached to the head. At least one of the sides has at least one longitudinally extending rib, with each rib having a width which is less than the groove width.

In another aspect of the invention, the head of the elongate strap includes a locking slot with opposing walls, each wall having at least one locking tooth. In yet another aspect of the invention, the head of the elongate strap includes a hinge section which allows hinged movement of the head in a direction transverse to the longitudinal extension of the strap. In a further aspect of the invention, the head of the elongate strap includes a mounting throughhole for mounting the elongate strap to a mounting surface.

An advantage of the present invention is that the longitudinally extending ribs on the elongate strap inhibit the convoluted tubing from moving in a longitudinal direction.

Another advantage is that the elongate strap may be inserted from either side of the head and still interlock with the teeth in the locking slot.

Yet another advantage is that the hinge section allows flexible movement of the head relative to the mounting throughhole and mounting structure.

A further advantage is that the mounting throughhole formed in the head allows the elongate tie to be securely fastened to a mounting surface.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
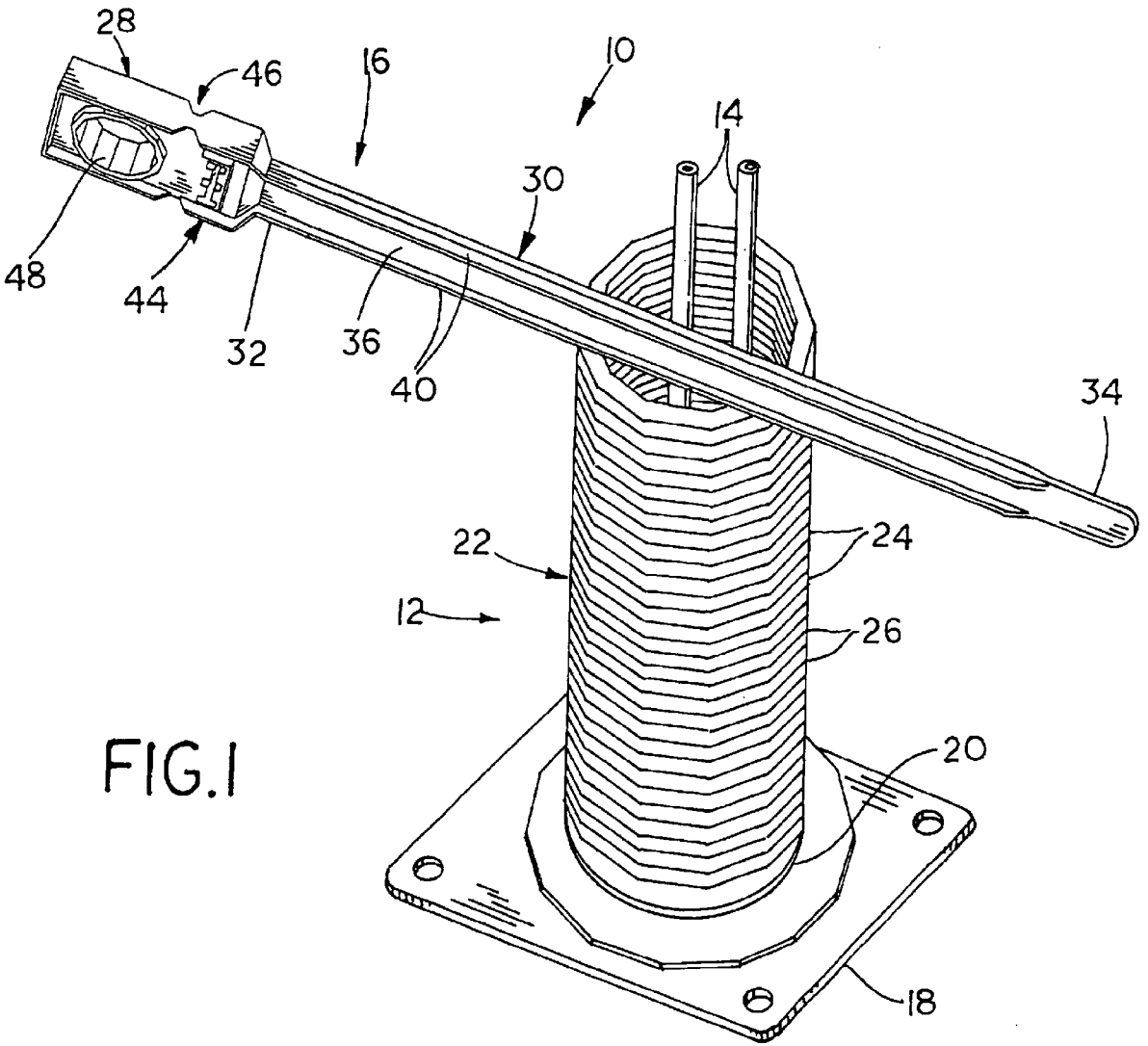
FIG. 1 is a perspective view of an electrical assembly of the present invention, including convoluted tubing, electrical conductors and an electrical tie.

Referring now to the drawings, and more particularly to FIG. 1, there is shown an embodiment of an electrical assembly 10 of the present invention, which generally includes an electrical convoluted tubing 12, a plurality of electrical conductors 14 and an electrical tie 16. Electrical assembly 10 generally is used for routing electrical conductors 14 form one physical location to another, while at the same time inhibiting mechanical wear to electrical conductors 14 and routing electrical conductors 14 in an aesthetically appealing manner. Electrical assembly 10 may be used for any suitable application, such as household or commercial appliances, engines, lighting systems, etc.

Electrical conductors 14 may be of any suitable number, size or configuration, depending upon the particular application. For example, electrical conductors 14 may be in the form of individual, insulated conductors (as shown in FIG. 1), a multi-conductor cable, power and/or data conductors, etc.

Convoluted tubing 12 is a flexible, plastic convoluted tubing which carries electrical conductors 14 therein. Convoluted tubing 12 may be of any suitable diameter, depending upon the particular application. In the embodiment shown, convoluted tubing 12 is attached to an end of a closed wiring trough using a connector plate 18. Connector plate 18 includes a mounting flange 20 with an inside diameter which mates with outer surface 22 of convoluted tubing 12.

Convoluted tubing 12 includes a plurality of generally parallel, annular convolutions 24 at outer surface 22. Convolutions 24 define respective grooves 26 therebetween, with each groove 26 having a common width. Convolutions 24 also have a common width, which may be the same as or different from the width of grooves 26. Of course, given the flexible nature of convoluted tubing 12, although the width of grooves 26 is relatively constant when convoluted tubing 12 is in a generally linear state, the width of grooves 26 may vary if convoluted tubing 12 is flexed around a corner, etc.

Figure 2:
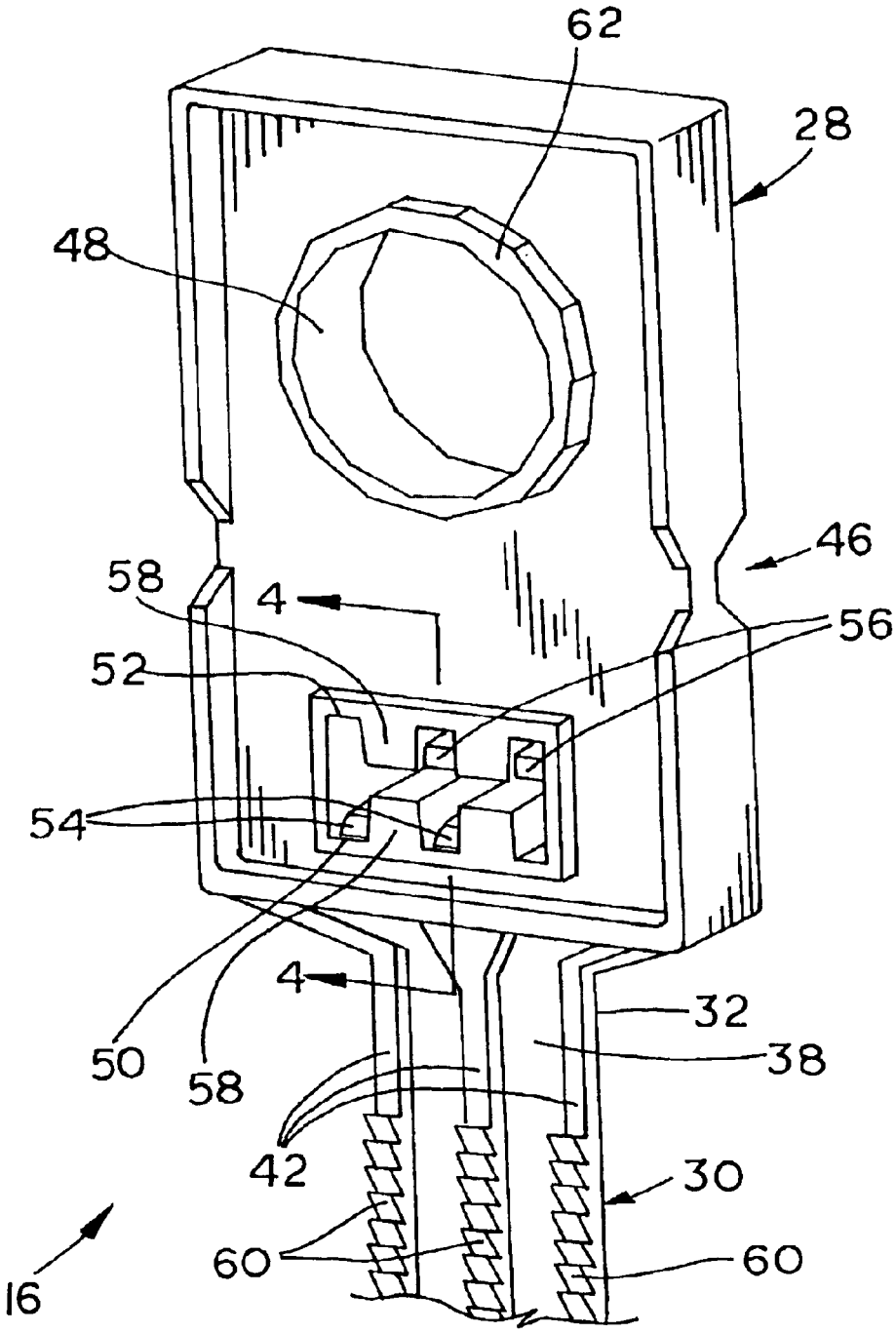
FIG. 2 is an enlarged, perspective view of the electrical tie as viewed from one side of the elongate tie.
Figure 3:
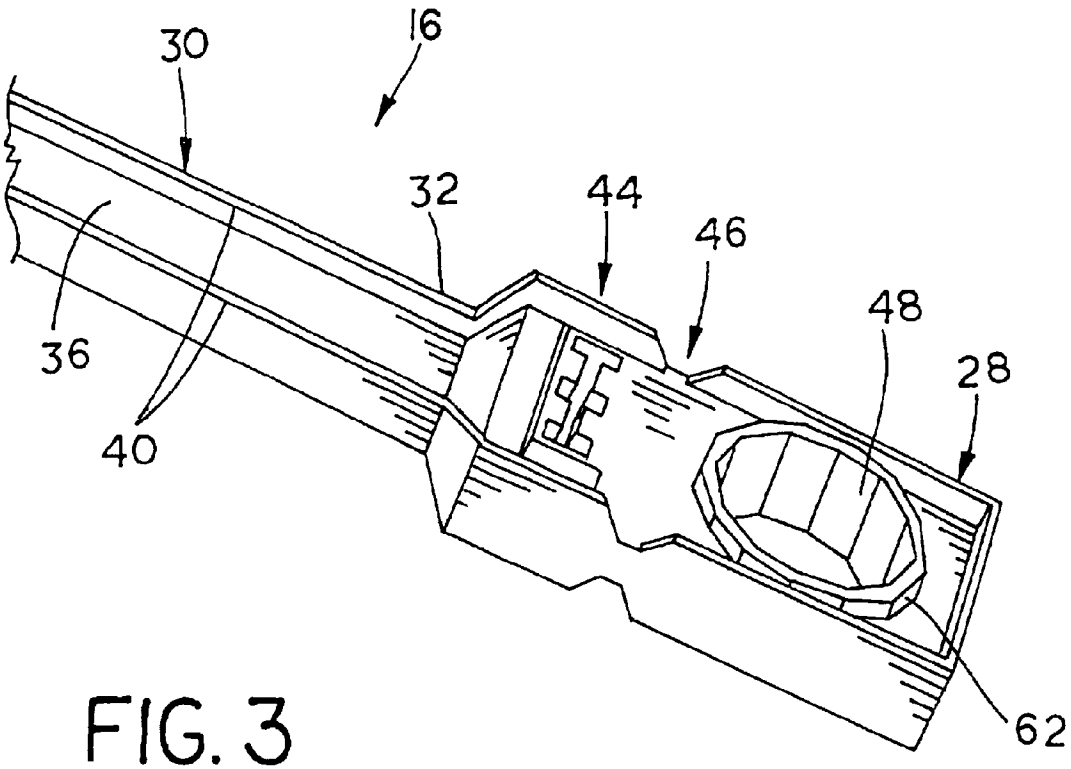
FIG. 3 is an enlarged, perspective view of the electrical tie as viewed from the other side of the elongate tie.

Electrical tie 16 (shown in more detail in FIGS. 2–4) generally includes a head 28 and elongate strap 30. Elongate strap 30 includes an end 32 which is attached to head 28 and a free distal end 34. Elongate strap 30 also includes opposing sides 36 and 38 which each include a plurality of generally parallel ribs 40 and 42, respectively, which extend a substantial portion of a length of sides 36 and 38. Ribs 40 are in the form of two ends which extend along the longitudinal edges of side 36. Ribs 42 are in the form of three ribs which extend along the longitudinal edges as well as the middle of side 38. Ribs 42 include serrations, the function of which will be described in more detail hereinafter. Ribs 40 and 42 each have a width which is less than a width of grooves 26, thereby allowing ribs 40 and 42 to be received within grooves 26 and thereby prevent longitudinal displacement of convoluted tubing 12. Moreover, the distance between ribs 40 and 42 is spaced such that ribs 40 and 42 are received within corresponding grooves 26. In the embodiment shown, ribs 40 are spaced to be received within alternating grooves 26, and ribs 42 are spaced to be received within adjacent grooves 26.

Head 28 generally includes a locking slot 44, hinge section 46 and mounting throughhole 48.

Locking slot 44 includes opposing walls 50 and 52. Extending from each wall 50 and 52 are three locking teeth 54 and 56, respectively, separated by dividers 58. Teeth 54 and 56 and dividers 58 are configured to receive ribs 40 and 42 within locking slot 44, regardless of whether elongate strap 30 is inserted from one side of head 28 or the other.

Figure 4:
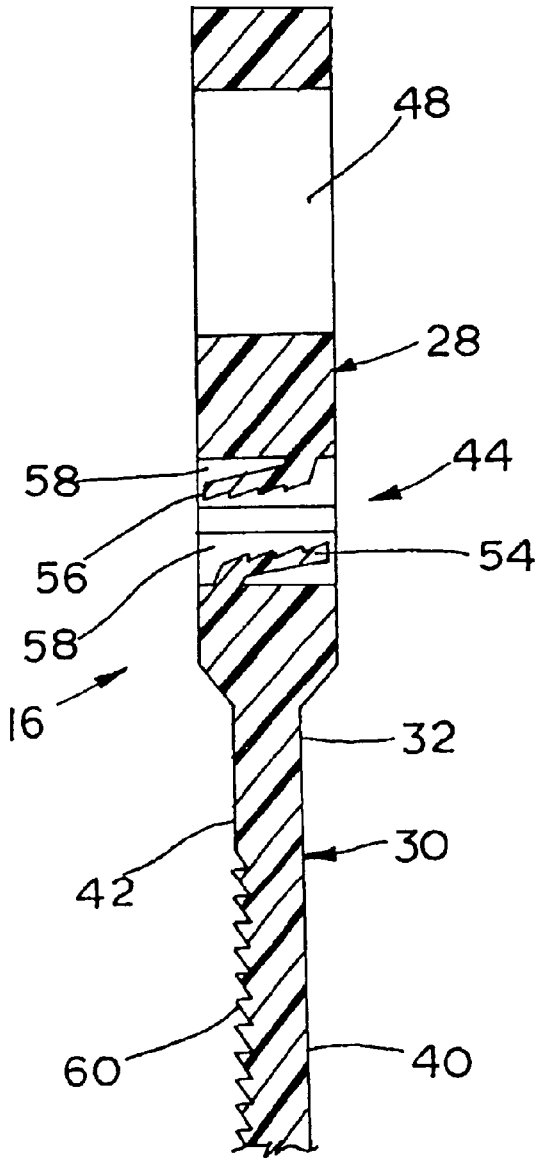
FIG. 4 is an enlarged, sectional view taken along line 4—4 in FIG. 2.

More particularly, ribs 42 include serrations which interlock with either teeth 54 or teeth 56, depending upon the side of head 28 from which elongate strap is inserted. Referring to FIG. 4, if elongate strap is looped and inserted from the left side of head 28, serrations 60 interlock with teeth 54. On the other hand, if elongate strap 30 is looped and inserted from the right side of head 28, serrations 60 interlock with teeth 56.

Regardless of the direction of insertion of elongate strap 30 within locking slot 34, respective teeth 54 and 56 are biased by and interlock with serrations 60. Teeth 56 are configured as ramped, cantilever beams so that they are biased away from serrations 60 and are retained in locking engagement with serrations 60.

Hinged section 46 is formed with a thinned section in head 28, thereby generally defining a "living hinge" allowing locking slot 44 to move relative to mounting throughhole 48. In the embodiment shown, hinge section 46 includes a thinned section extending generally perpendicular to the longitudinal extension of elongate strap 30.

Mounting throughhole 48 has a generally cylindrical shape with an inside diameter which is sized to receive a mounting fastener, such as a bolt, therein. A shoulder 62 provides a bearing surface against which the mounting bolt may be biased for holding head 28 relative to a mounting structure.

During use, convoluted tubing 12, with electrical conductors 14 therein, is routed from one location to another within a particular application. At one or more various specified and/or desired points, an electrical tie 16 is used to hold convoluted tubing 12 relative to some other structure, such as a mounting structure, other convoluted tubing, electrical cables, etc. When mounted to a mounting structure, a bolt is passed through mounting throughhole 48 and tightened such that the bolt head rests against shoulder 62. Elongate strap 30 is then wrapped around convoluted tubing 12 in either desired direction, depending upon space availability, aesthetics, etc. Depending upon the direction of wrap around convoluted tubing 12, serrations 60 of ribs 42 engage either teeth 54 or teeth 56 within locking slot 44. Ribs 40 on the opposite side of elongate strap 30 bias against but do not interlock with the opposing teeth 54 or 56. Hinge section 46 allows head 28 to flex in a direction generally perpendicular to the longitudinal extension of elongate strap 30, between locking slot 44 and mounting throughhole 48.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical tie, comprising:

a head; and an elongate strap having a longitudinal direction, a first side, a second side and an end, said end being attached to said head, said first side having at least two longitudinally extending ribs, said second side having at least three longitudinally extending ribs, each said rib being substantially parallel with each other, each said rib extending a majority of a longitudinal length of a corresponding side, said longitudinally extending ribs on said first side being spaced apart in a direction transverse to said longitudinal direction, said longitudinally extending ribs on said second side being spaced apart in a direction transverse to said longitudinal direction, said at least three longitudinally extending ribs on said second side including serrations.

2. The electrical tie of claim 1, said at least two ribs comprising two ribs on said first side and said at least three ribs comprising three ribs on said second side.

3. An electrical tie, comprising:

an elongate strap having opposing sides and an end, at least one said side having a plurality of serrations, said serrations include one of projections and recesses, at least one said side has at least one longitudinally extending rib, at least one said rib including serrations in said rib; and a head attached to said end, said head including a locking slot for receiving said strap therein, said locking slot including opposing walls, each said wall having three rib openings, each said wall including at least one locking tooth.

4. The electrical tie of claim 3, each said wall including a plurality of locking teeth.

5. The electrical tie of claim 4, said plurality of locking teeth having a ramped, cantilever beam construction.

6. An electrical tie, comprising:

an elongate strap having a longitudinal extension, opposing sides and an end, at least one said side including serrations; and a head attached to said end, said head including a locking slot for receiving said strap therein and interconnecting with said serrations, said head including opposing sides and a perimeter wall extending on each said opposing side, said wall located on a perimeter of said head, said perimeter wall including at least one notch on each said opposing side in said perimeter wall, said notches creating a hinge section allowing hinged movement of said head in a direction transverse to said longitudinal extension.

7. The electrical tie of claim 6, said hinged section comprising a thinned section.

8. The electrical tie of claim 6, said hinge section allowing hinged movement of said head in a direction generally perpendicular to said longitudinal extension.

* * * * *